US008595942B2

(12) United States Patent
Ho

(10) Patent No.: US 8,595,942 B2
(45) Date of Patent: Dec. 3, 2013

(54) SAFE UTILITY KNIFE

(76) Inventor: Chun-Feng Ho, Taichung (TW)

( * ) Notice: Subject to any disclaimer, the term of this patent is extended or adjusted under 35 U.S.C. 154(b) by 241 days.

(21) Appl. No.: 13/053,544

(22) Filed: Mar. 22, 2011

(65) Prior Publication Data

US 2011/0232104 A1 Sep. 29, 2011

(30) Foreign Application Priority Data

Mar. 24, 2010 (TW) ..... 99205110 U

(51) Int. Cl.
*B26B 1/00* (2006.01)
*B26B 1/08* (2006.01)

(52) U.S. Cl.
USPC ..... 30/151; 30/160; 30/161; 30/162

(58) Field of Classification Search
USPC ..... 30/155–157, 161, 160, 331, 151, 329, 30/339
See application file for complete search history.

(56) References Cited

U.S. PATENT DOCUMENTS

| | | | | | |
|---|---|---|---|---|---|
| 4,769,912 | A * | 9/1988 | Davis | 30/162 |
| 5,095,624 | A * | 3/1992 | Ennis | 30/161 |
| 5,203,085 | A * | 4/1993 | Berns | 30/163 |
| 6,163,963 | A * | 12/2000 | Huang | 30/162 |
| 6,357,120 | B1 * | 3/2002 | Khachatoorian et al. | 30/162 |
| 6,415,514 | B1 * | 7/2002 | Chun | 30/162 |
| 7,337,546 | B2 * | 3/2008 | Cheng | 30/156 |
| 8,074,362 | B2 * | 12/2011 | Gui et al. | 30/156 |
| 2003/0037444 | A1 * | 2/2003 | Chunn | 30/337 |
| 2005/0055833 | A1 * | 3/2005 | Scarla | 30/156 |
| 2005/0204567 | A1 * | 9/2005 | Ping | 30/161 |

* cited by examiner

*Primary Examiner* — Omar Flores Sanchez
(74) *Attorney, Agent, or Firm* — Rosenberg, Klein & Lee

(57) ABSTRACT

A safe utility knife is provided having a housing, a blade sliding seat, a pushing force generator, an acceleration detector, a stopper, a stopper pushing portion, and a sliding switch. When activated with a blade protruding out, and an acceleration due to a sudden dropping movement occurs, the acceleration detector moves from a low acceleration position to a high acceleration position. It also presses down the sliding switch and the stopper so that the stopper moves from a locking position to a non-locking position. The blade sliding seat is pulled by the pulling force generator to a blade storing position to protect against accidental injury. The knife can be operated by one hand and is suitable for regular blades available on the market. In addition, it can be switched to manual automatic blade returning mode.

8 Claims, 10 Drawing Sheets

SAFE UTILITY KNIFE

BACKGROUND OF THE INVENTION

1. Field of the Invention

The present invention relates to a safe utility knife. It can avoid the user to be injured accidentally. It can be operated by one hand to protrude the blade. This invention is suitable for regular blades available on the market. In addition, it can switch to the mode for manual automatic blade returning.

2. Description of the Prior Art

As shown in FIG. 13, it shows a traditional utility knife with automatic blade returning function. It includes a body 91, an engaging bar 92, a special blade 93, and a spring 94. The body 91 includes a body securing end 911, a pivoting part 912, a limit spring 913, a sliding rail 914, a front opening 915, and a rear opening 916. The engaging bar 92 has an engaging recess 921. This special blade 93 includes a blade portion 931, a pushing rod 932, a blade securing end 933, and an engaging protrusion 934. The engaging bar 92 has one end that is pivoted on the pivoting part 912 and is limited by the pushing force of the limit spring 913. The special blade 93 is able to slide on the sliding rail 914. This spring 94 has two ends that are disposed with the body securing end 911 and the blade securing end 933 respectively.

Therefore, by pushing the pushing rod 932 of the special blade 93, the engaging protrusion 934 and the engaging recess 921 are engaged together so as to make the blade portion 931 protruding from the front opening 915. As illustrated in FIG. 14, when a shaking, swaying, swinging or hitting force is generated by the user (who is holding it) and this force is larger than the pushing force of the limit spring 913, the engaging bar 92 will rotate up an angle so that it makes the engaging recess 921 separating from the engaging protrusion 934. Hence, the special blade 93 is pulled back by the limit spring 94. Accordingly, the special blade 93 moves back via this sliding rail 914.

However, about the traditional utility knife, it still has the following problems.

[1] It needs two hands to operate it. When the user wants to push the special blade 93 out, it needs one hand to hold one the body 91. Besides, it needs the other hand to push on the pushing rod 932 of the special blade 93. Thus, it is impossible to operate this action by one hand only.

[2] It is required the special blade. With regard to the traditional utility knife with automatic blade retuning function, only the special blade 93 can be used. Such special blade 93 is not a regular or common blade which is available on the market. It needs a special order (to manufacture it). Therefore, the cost for such special blade 93 is relative high.

[3] The special blade 93 is easy to break out. About the traditional utility knife with automatic blade returning function, the length of the pushing rod 932 of the special blade 93 is longer and the diameter of it is smaller. So, the special blade 93 is easy to be broken due to any hitting or dropping.

[4] Its safety is low. The traditional utility knife with automatic blade returning function has the disadvantage of easy breaking (about the special blade 93). If the special blade 93 is broken while the user is using it, it is possible to make the engaging protrusion 934 separating from the engaging recess 921. Then, the user might be injured.

[5] The automatic blade returning function is activated by gravity only. Concerning this traditional utility knife, the special blade 93 can be moved back by shaking, swaying, swinging or hitting method so as to force the special blade 93 back due to gravity. At this moment, the engaging protrusion 932 separates from the engaging recess 921, so as to achieve the automatic blade returning function.

SUMMARY OF THE INVENTION

The objects of the present invention are to provide a safe utility knife. In which, it can avoid the user to be injured accidentally. It can be operated by one hand to protrude the blade. It is suitable for regular blades available on the market. Plus, it can switch to the mode for manual automatic blade returning. Therefore, it can solve the problems of the traditional utility knife listed as follows. It has to be operated by two hands to protrude the blade. It is required the special blade. The special blade is easy to break out. Plus, its safety is low.

In order to achieve the above mentioned objects, a technical solution is provided. A safe utility knife comprising:

a housing having an inner space, a blade opening, a sliding recess, and a first securing portion; the housing having a front end and a rear end; the blade opening being disposed on the front opening; the first securing portion being adjacent to the rear end; the sliding recess being disposed on an upper surface of the housing and being connected to the inner space; the sliding recess having a locking recess;

a blade sliding seat being movable in the inner space back and forth and having at least a blade storing position and a blade protruding position; the blade sliding seat being disposed with a second securing portion, an acceleration detector shaft, a stopper shaft, a central block, and a curved sliding path zone; the curved sliding path zone including a front section, a curved section, and a rear section; the front section being a section toward the front end, the central block being between the front end and the rear end, the curved section being substantially positioned beneath the central block;

a pulling force generator having two ends, one end being connected with the first securing portion and the other end being connected with the second securing portion, the pulling force generator being provided for pulling the blade sliding seat back to the blade storing position;

an acceleration detector being pivoted on the acceleration detector shaft and being rotatable between a low acceleration position and a high acceleration position with an angle; the acceleration detector having a first hole, a weighting element, and a safety locker;

a stopper being movable between a locking position and a non-locking position, the stopper having a stopping protruding portion and a locking protruding portion;

a stopper pushing portion for generating a pushing force so as to keep the stopper being pushed from the non-locking position to the locking position;

a sliding switch being secured on the blade sliding seat and being movable along the sliding recess; the sliding switch having a pushing portion, a rotatable controlling arm, and a resilient element; the rotatable controlling arm has a controller jut which is movable in the curved sliding path zone;

when the acceleration detector is positioned at the low acceleration position, the safety locker is positioned behind the central block and the controlling jut of the rotatable controlling arm is positioned in the rear section of the curved sliding path zone, the pushing portion being pushed so as to cause the blade sliding seat moving forward from the blade storing position to the blade protruding position, while arriving the blade protruding position, the locking protruding portion of the stopper being positioned at the locking recess of the housing so as to lock up the blade sliding seat; when an acceleration caused by a suddenly dropping down movement exceeding a predetermined value, the weighting element moving up so as to cause the acceleration detector moving from the low acceleration position to the high acceleration position and further forcing the safety locker moving down and pressing down the rotatable controlling arm and the stopper so that the stopper moving from the locking position to the non-locking position; also, the locking protruding portion of the stopper leaving from the locking recess so as to cause the blade sliding seat pulling back by the pulling force generator so that the blade sliding seat is pulled back to the blade storing position for achieving a safe and automatic blade returning function.

BRIEF DESCRIPTION OF THE DRAWINGS

FIG. 14 is a view showing that the special blade of the traditional utility knife is returned in.

DETAILED DESCRIPTION OF THE PREFERRED EMBODIMENT

Figure 1:
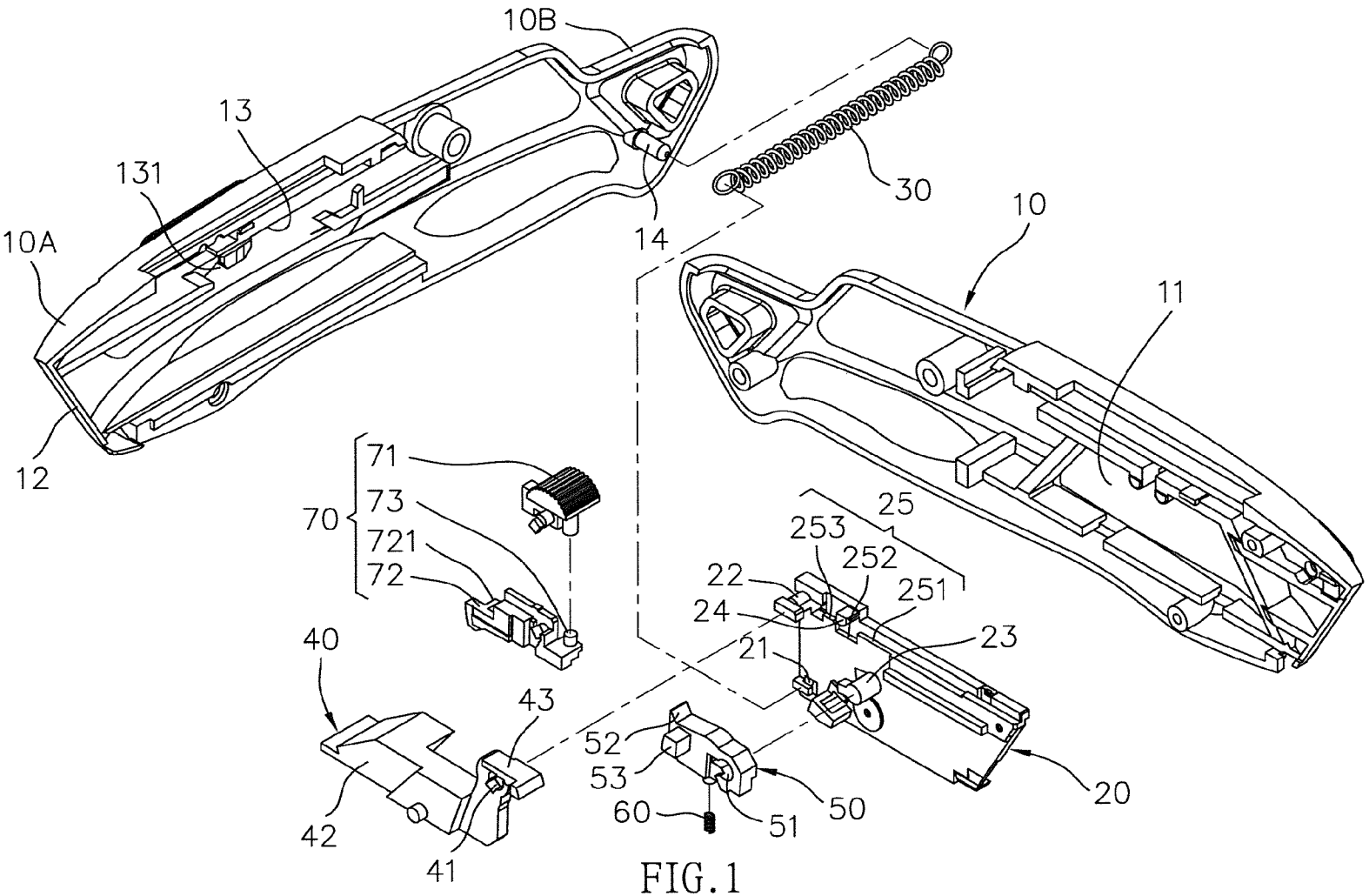
FIG. 1 is an exploded view of the present invention.
Figure 2:
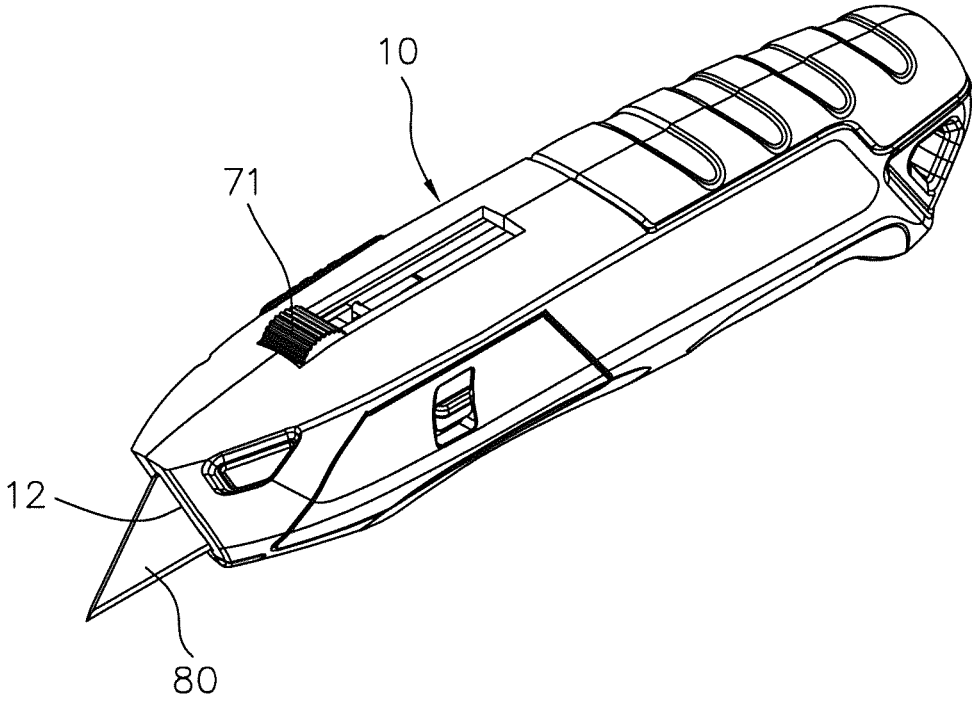
FIG. 2 is a perspective view of the present invention.

Referring to FIGS. 1 to 7, the present invention is a safe utility knife. It mainly comprises a housing 10, a blade sliding seat 20, a pushing force generator 30, an acceleration detector 40, a stopper 50, a stopper pushing portion 60, and a sliding switch 70.

About this housing 10, it has an inner space 11, a blade opening 12, a sliding recess 13, and a first securing portion 14. The housing 10 has a front end 10A and a rear end 10B. The blade opening 12 is disposed on the front opening 10A. The first securing portion 14 is adjacent to the rear end 10B. The sliding recess 13 is disposed on an upper surface of the housing 10 and is connected to the inner space 11. This sliding recess 13 has a locking recess 131.

With regard to the blade sliding seat 20, it can move in the inner space 11 back and forth. Also, the blade sliding seat 20 has at least a blade storing position P1 and a blade protruding position P2. The blade sliding seat 20 is disposed with a second securing portion 21, an acceleration detector shaft 22, a stopper shaft 23, a central block 24, and a curved sliding path zone 25. Furthermore, the curved sliding path zone 25 includes a front section 251, a curved section 252, and a rear section 253. The front section 251 is defined as a section toward the front end 10A. The central block 24 is between the front end 10A and the rear end 10B. The curved section 252 is substantially positioned beneath the central block 24.

Concerning the pulling force generator 30, it has two ends. One end is connected with the first securing portion 14 and the other end is connected with the second securing portion 21. The pulling force generator 30 is provided for pulling the blade sliding seat 20 back to the blade storing position P1.

With reference to the acceleration detector 40, it is pivoted on the acceleration detector shaft 22 and is rotatable between a low acceleration position P3 and a high acceleration position P4 with an angle. Plus, the acceleration detector 40 has a first hole 41, a weighting element 42, and a safety locker 43.

About the stopper 50, it is movable between a locking position P5 and a non-locking position P6 with another angle. This stopper 50 has a second hole 51, a stopping protruding portion 52 and a locking protruding portion 53.

The stopper pushing portion 60 is provided for generating a pushing force so as to keep the stopper 50 being pushed from the non-locking position P6 to the locking position P5.

Concerning the sliding switch 70, it is secured on the blade sliding seat 20 and is movable along the sliding recess 13. The sliding switch 70 has a pushing portion 71, a rotatable controlling arm 72, and a resilient element 73. The rotatable controlling arm 72 has a controller jut 721 (or called controller protrusion) which is movable in the curved sliding path zone 25.

When the acceleration detector 40 is positioned at the low acceleration position P3, the safety locker 43 is positioned behind the central block 24 and this controlling jut 721 of the rotatable controlling arm 72 is positioned in the rear section 253 of the curved sliding path zone 25. Meanwhile, this pushing portion 71 is pushed so as to cause the entire blade sliding seat 20 moving forward from the blade storing position P1 to the blade protruding position P2. When it moves to the blade protruding position P2, the locking protruding portion 53 of the stopper 50 is positioned at the locking recess 131 of the housing 13 so as to lock up the blade sliding seat 20. In addition, when an acceleration caused by a suddenly dropping down movement exceeding a predetermined value, the weighting element 42 moves up immediately so as to cause the acceleration detector 40 moving from the low acceleration position P3 to the high acceleration position P4 and further forcing the safety locker 43 moving down and pressing down this rotatable controlling arm 72 and the stopper 50. So, the stopper 50 moves from the locking position P5 to the non-locking position P6. Also, the locking protruding portion 53 of the stopper 50 leaves from the locking recess 131 so as to cause the blade sliding seat 20 pulling back by the pulling force generator 30 so that the blade sliding seat 20 is pulled back to its original blade storing position P1 for achieving a safe and automatic blade returning function.

In addition, the first hole 41 of the acceleration detector 40 is pivoted with the acceleration detector shaft 22. The second hole 51 of the stopper 50 is pivoted with the stopper shaft 23.

With regard to the pulling force generator 30, stopper pushing portion 60, and the resilient element 73 of the sliding switch 70, they can be regular springs. Their spring shapes and properties can be different depending upon different requirements at different positions.

Figure 3:
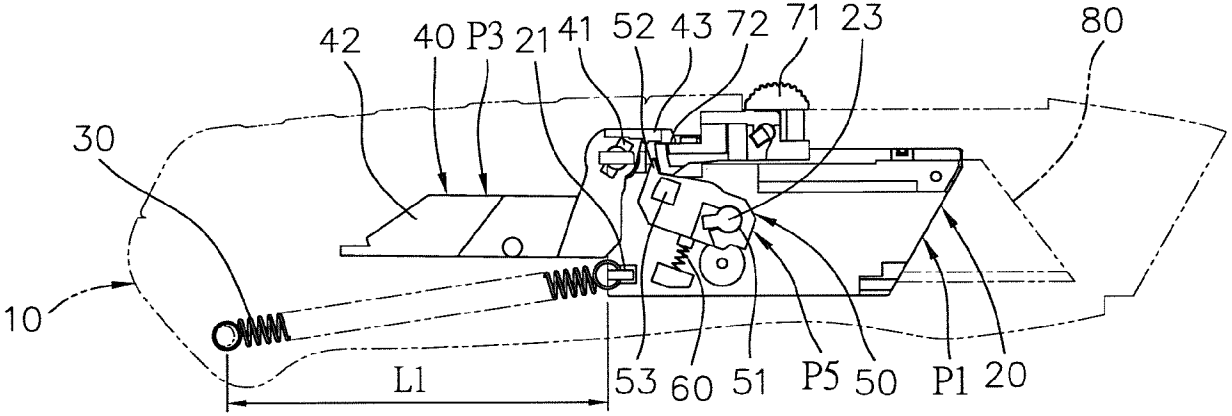
FIG. 3 is a view of the present invention when its blade is protruded out.

As illustrated in FIG. 3, it shows the blade 80 of the present invention is retreated. The acceleration detector 40 is positioned at the low acceleration position P3. The blade sliding seat 20 is stays at its original blade storing position P1. Plus, the pulling force generator 30 has a first length L1.

Figure 4:
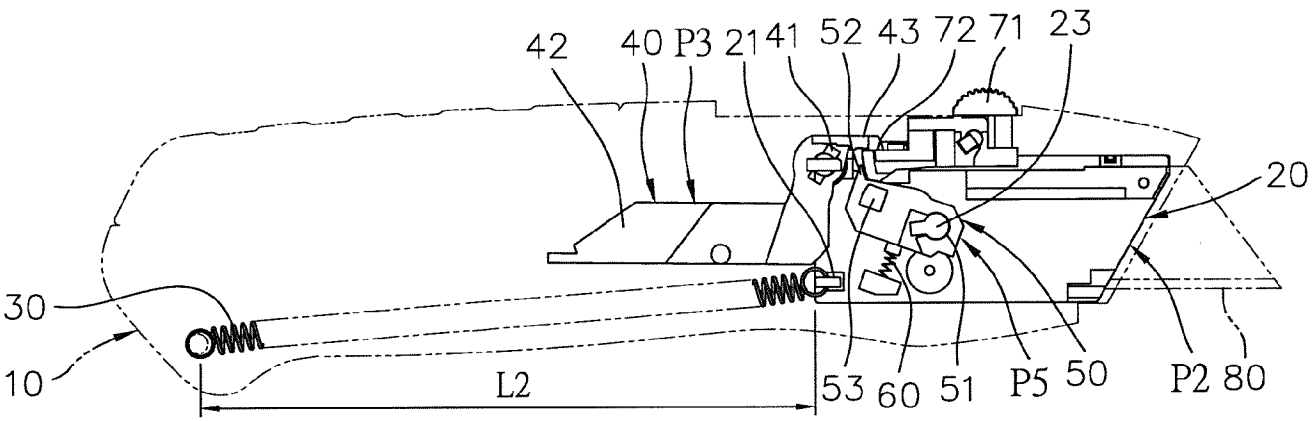
FIG. 4 is a view of the present invention when its blade is stored inside.

As exhibited in FIG. 4, when the pushing portion 71 is pushed forward, it will drive the blade sliding seat 20 moving forward to the blade protruding position P2 (the blade 80 extends out the housing 10). At this moment, the pulling force generator 30 is prolonged from the first length L1 to a second length L2.

Figure 5:
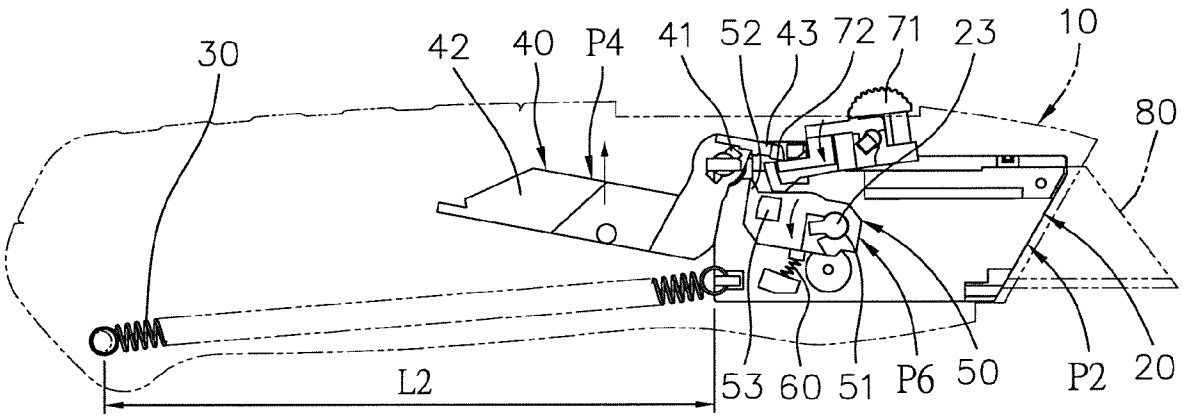
FIG. 5 is a view showing process one of the automatic blade returning action of this invention.
Figure 6:
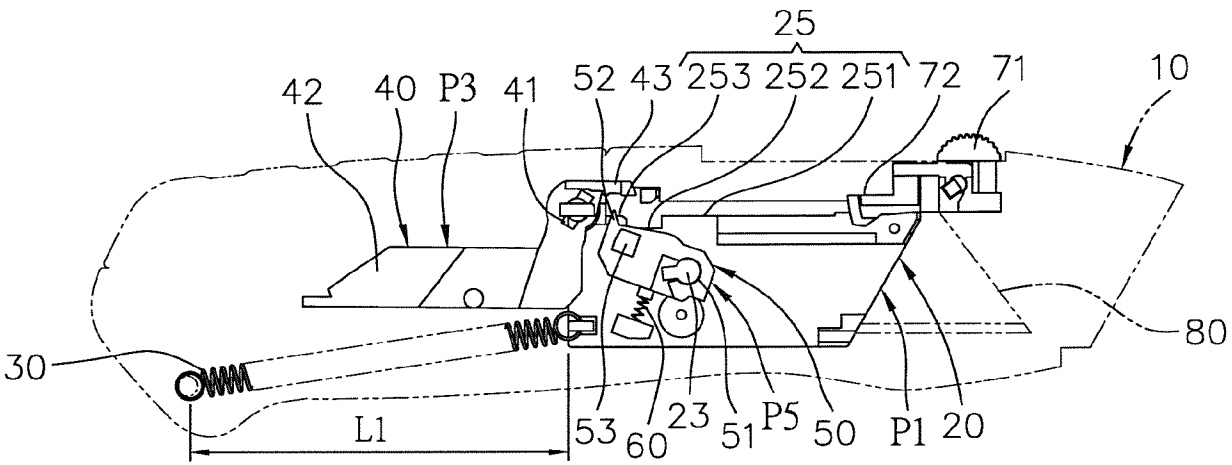
FIG. 6 is a view showing process two of the automatic blade returning action of this invention.

As shown in FIGS. 5 and 6, when an acceleration caused by a suddenly dropping down movement exceeding a predetermined value, the weighting element 42 moves up immediately so as to cause the acceleration detector 40 moving from the low acceleration position P3 to the high acceleration position P4. Further, it also forces the safety locker 43 moving down and pressing down this rotatable controlling arm 72 and the stopper 50. Hence, the stopper 50 moves from the locking position P5 to the non-locking position P6. That is, the entire blade sliding seat 20 is pulled by the pulling force generator 30 (from the second length L2 to the first length L1). Meanwhile, the blade sliding seat 20 is pulled back to its original blade storing position P1 for achieving a safe and automatic blade returning function. Of course, it is assumed that such sudden acceleration happens during the time that the user is using this utility knife (the user's finger still press one the pushing portion 71). Under this condition, when the safety locker 43 presses down the rotatable controlling jut 72, the rotatable controlling arm 72 is moved from the rear section 253 of the curved sliding path zone 25 to the curved section 252. The pulling force generator 30 will push the blade sliding seat 20 back. However, due to fact that the pushing portion 71 is pressed by the user's finger, the sliding switch 70 will not move. The controlling jut 721 moves from the curved section 252 to the front section 251. Also, the rotatable controlling arm 72 will leave a position under the safety locker 43.

Figure 7:
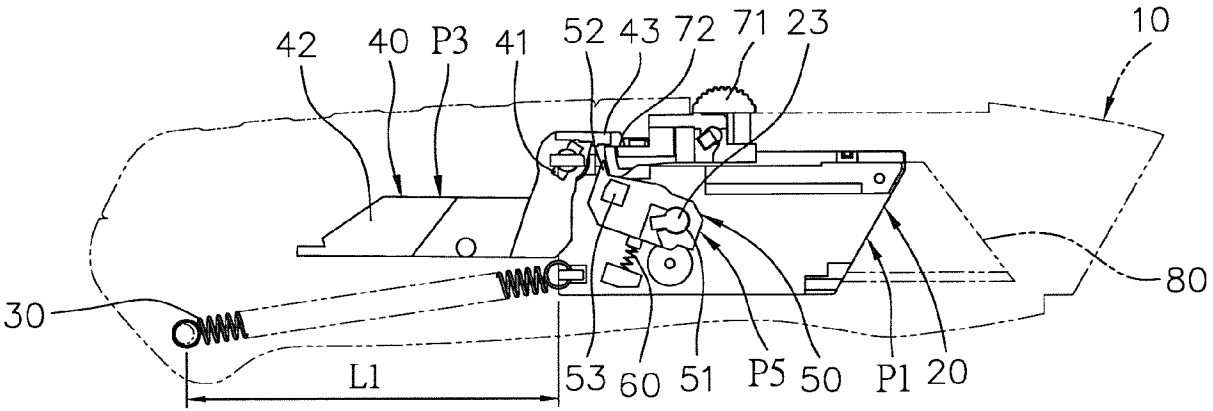
FIG. 7 is view showing that the automatic blade returning action of this invention is completed.

After the blade sliding seat 20 moves back, the user needs to do a re-start action for the sliding switch 70 for pushing this blade sliding seat 20 again. Referring to FIG. 7, concerning the re-start action, it is to push the pushing portion 71 back so that the sliding switch 70 moves back. The controlling jut 721 returns to the rear section 253 of the curved sliding path zone 25. The rotatable controlling arm 72 moves to the position just under the safety locker 43 (from the condition of FIG. 6 to the condition of FIG. 7).

Figure 8:
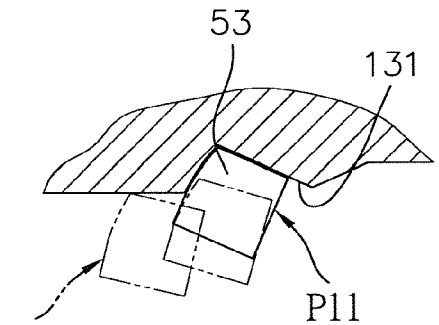
FIG. 8 is a view illustrating the manual blade returning operation.
Figure 9A:
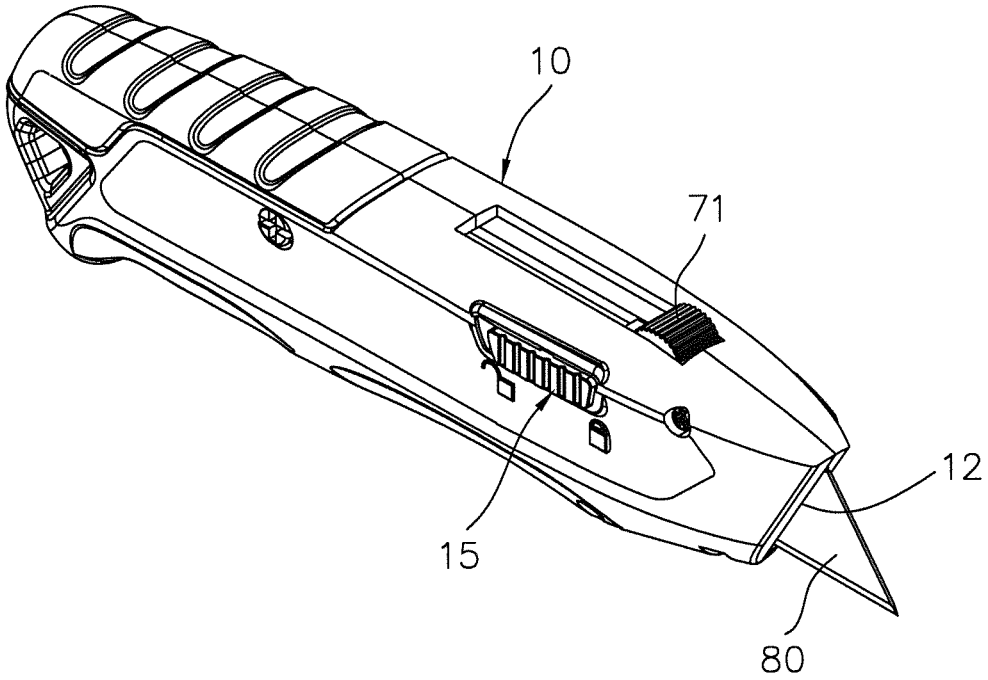
FIG. 9A is a perspective view of the second preferred embodiment of the present invention.
Figure 9B:
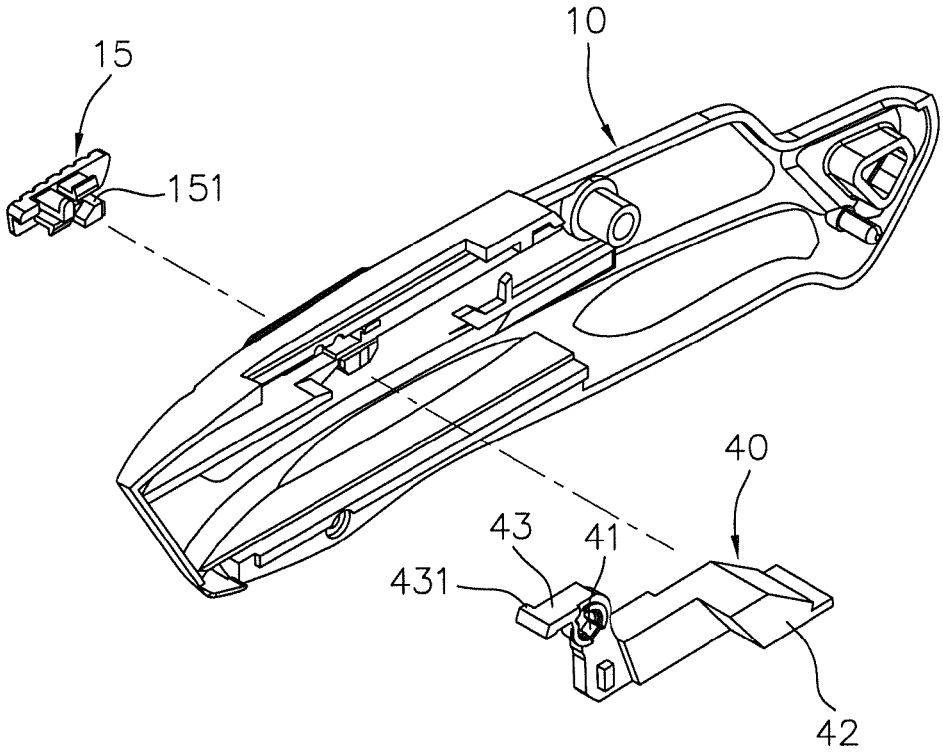
FIG. 9B is an exploded view of the second preferred embodiment of this invention.

About the design of this invention, except the automatic returning activated by suddenly dropping down acceleration, there is another operation mode called manual returning (by the user). Referring to FIGS. 1 to 8, the locking recess 131 of the sliding recess 13 is designed to have two tilted surfaces. When the user's finger pushes the pushing portion 71 back, the locking protruding portion 53 of the stopper 50 will slide over the tilted surface of the locking recess 131 and separate from the locking recess 131 (as shown in FIG. 8, the locking protruding portion 53 moves from the first position P11 to the second position P12). Therefore, the blade sliding seat 20 is pulled back by the pull force generator 30 for manual returning of the blade 80.

Figure 10A:
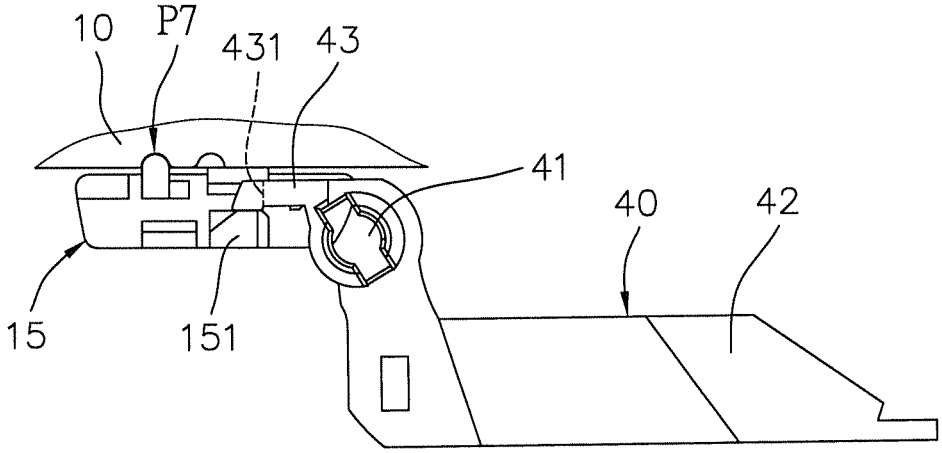
FIG. 10A shows the locked position of the second preferred embodiment of this invention.
Figure 10B:
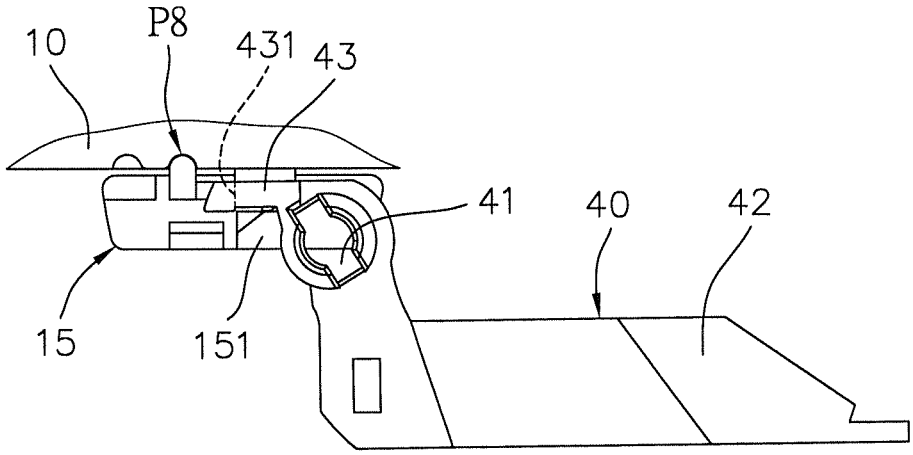
FIG. 10B shows the released position of the second preferred embodiment.

As illustrated in FIGS. 9A, 9B, 10A and 10B, they show the second preferred embodiment of the present invention. It further comprises a locking switch 15. This locking switch 15 includes a locking portion 151. The locking switch 15 is disposed on the housing 10 and has at least a locked position P7 and a released position P8. The safety locker 43 further includes an extending portion 431. As shown in FIG. 10A, when the locking switch 15 is positioned at the locked position P7, the locking portion 151 is beneath the extending portion 431 so that the acceleration detector 40 cannot rotated on the acceleration detector shaft 22. Under the circumstances, the acceleration detector 40 cannot move and is locked at the low acceleration position P3. So, the present invention cannot achieve the automatic blade returning function. As shown in FIG. 10B, when the locking switch 15 moves to the released position P8, the locking portion 151 moves away from the position beneath the extending portion 431, such that the acceleration detector 40 can rotate to any angle between the low acceleration position P3 and the high acceleration position P4. Under this condition, the present invention has the automatic blade returning function.

Figure 11:
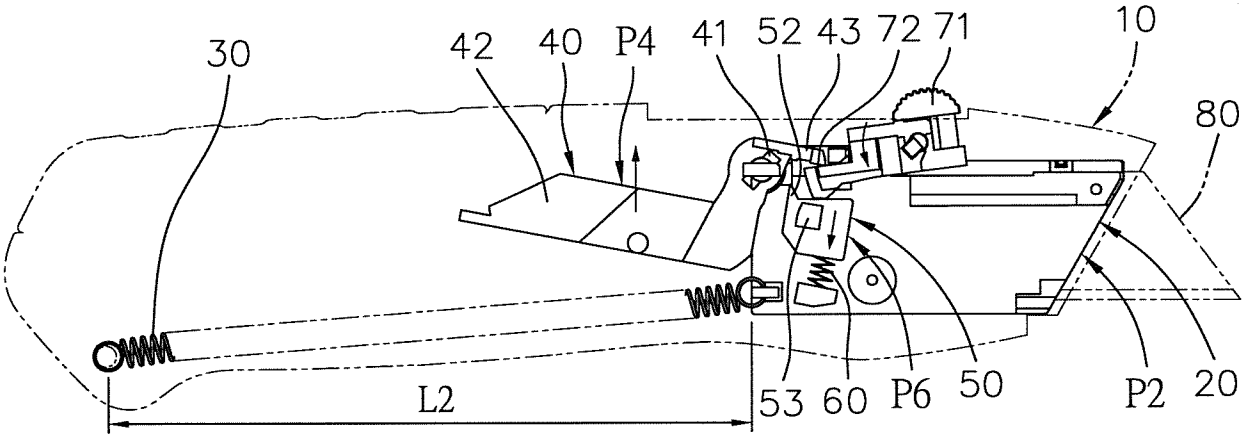
FIG. 11 illustrates condition one of the third preferred embodiment of this invention.
Figure 12:
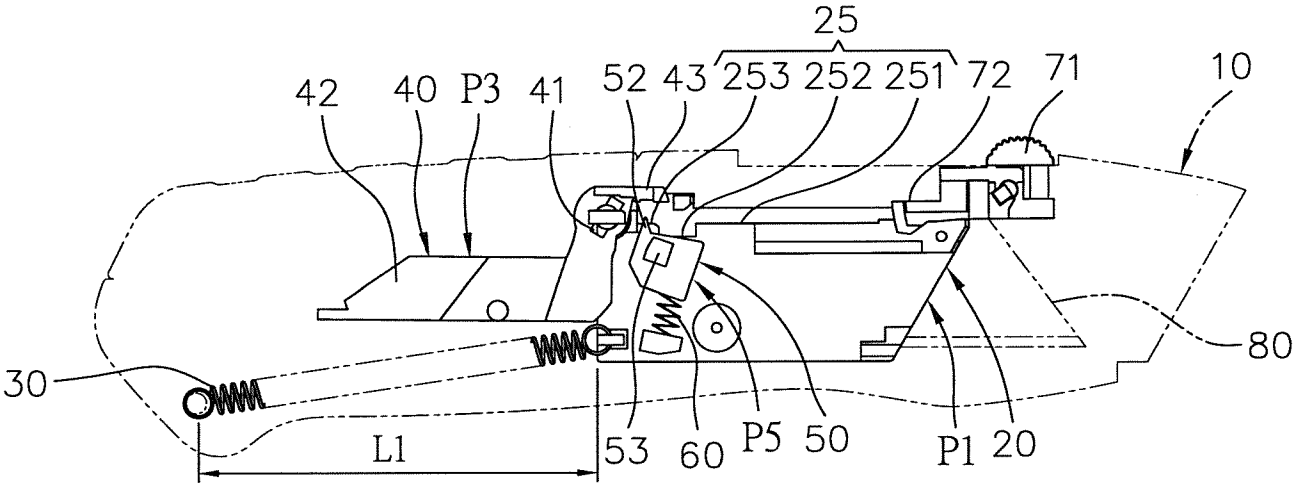
FIG. 12 illustrates condition two of the third preferred embodiment.
Figure 13:
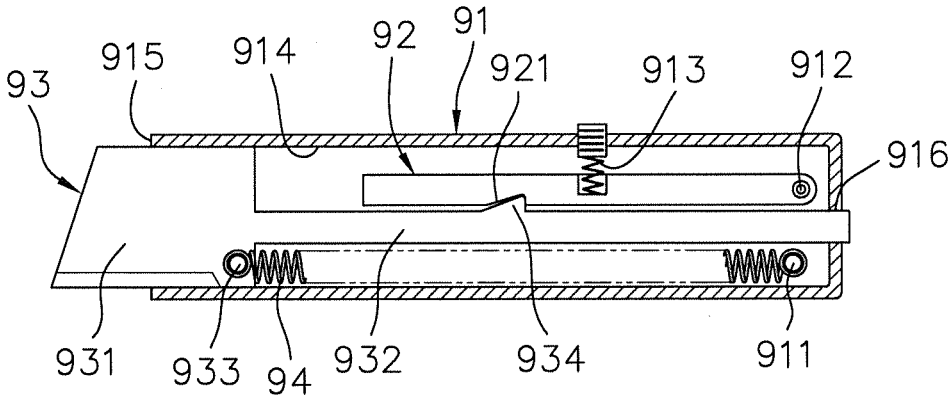
FIG.13 (PRIOR ART)
FIG. 13 is a view showing that the special blade of the traditional utility knife is protruded out.
Figure 14:
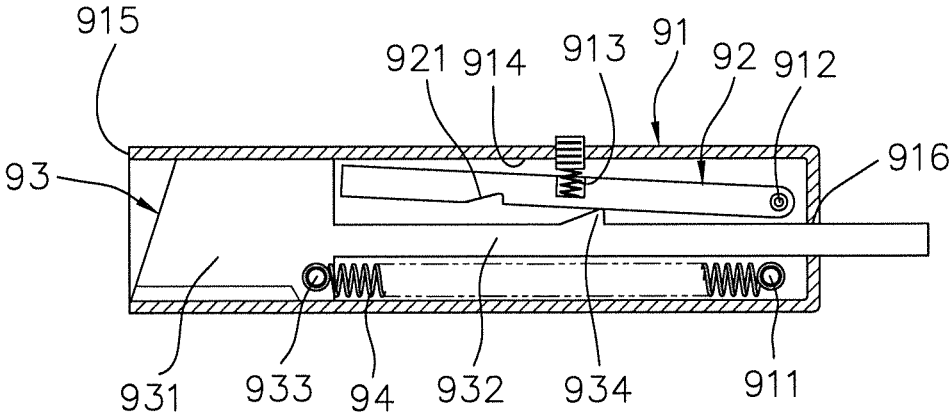
FIG.14 (PRIOR ART)

In addition, the stopper 50 is possible to move between the locking position P5 and the non-locking position P6. Except the rotating design mentioned in previous paragraph, it can be modified to move along a vertical straight line (or roughly straight line). Of course, if the stopper 50 moves up and down (along a vertical straight line), there is no the second hole 51. Also, the blade sliding seat 20 will not has the stopper shaft 23. As illustrated in FIGS. 11 and 12 (about the third preferred embodiment), they show the stopper 50 moves to the non-locking position P6 and the locking position P5 respectively. In which, the stopper 50 is able to move up and down along a substantially vertical straight line.

Based on the above-mentioned description, by utilizing the force caused by a suddenly occurred acceleration, the automatic blade returning function can be achieved. It can increase the safety of the user when one is using this invention (utility knife). For example, when a user uses a traditional utility knife (without automatic blade returning function) to cut an object (such as a hard board), this user will apply certain pressing force and drag this utility knife inward. When this traditional utility knife moves across the edge of the object, it will suddenly drop down (due to the applied force downward). Under this condition, it is possible to hurt the user's body (especially belly or thigh) accidently. However, for the same condition, the present invention's blade will return automatically due to the suddenly dropping down acceleration so as to avoid hurting the user accidently.

Therefore, the advantages and functions of the present invention can be summarized as follows.

[1] It can avoid the user to be injured accidentally. About the most existing utility knife in the market, it is rare or even no automatic blade returning function. When the user cuts over the edge of an object by using this kind of traditional utility knife (without automatic retuning function), the applied pressing force would cause this traditional utility knife drops down suddenly. Such suddenly dropping down condition is easy to hurt the user accidently. However, the present invention can utilize the suddenly drooping down acceleration to activate its automatic blade returning function, so that it can avoid the user to be injured accidently.

[2] It can be operated by one hand to protrude the blade. Regarding the traditional utility knife with automatic returning function, the user has to use two hands to work on it (one hand to hold the traditional utility knife, and the other hand to push the pushing rod section 932 of the special blade 93). It cannot be operated by one hand to protrude the special blade 93. So, the traditional one is not convenient. But, the present invention can be operated by one hand to protrude the blade 80. More specifically, it can be done by using one hand to hold the housing 10 and using a finger to push the pushing portion 71. By doing so, the blade 80 carried by the blade sliding seat 20 will move forward and protrude out from the housing 10.

[3] It is suitable for regular blades available on the market. About the traditional utility knife with the automatic blade returning function, it has to use a special blade 93 to achieve such function. Such special blade 93 is not common in the market. It needs a special order. Hence, its cost is relatively high and its availability is low. However, concerning the present invention, the blade sliding seat 20 can carry the blade 80, so it is suitable for regular blades 80 available on the market. There is no need to use the special blade 93 or the like. Thus, it is suitable for regular blades 80 available on the market.

[4] It can switch to the mode for manual automatic blade returning. About the traditional utility knife, there is no manual automatic blade returning function. Its automatic blade returning function is activated by shaking, swaying, swinging or hitting method so as to force the special blade 93 back due to gravity. However, the present invention's manual blade returning function can be achieved by pulling back the pushing portion 71 so that the locking protruding portion 53 will release the locking recess 131. Hence, the manual automatic blade returning can be achieved.

While this invention has been particularly shown and described with references to the preferred embodiments thereof, it will be understood by those skilled in the art that various changes or modifications can be made therein without departing from the scope of the invention by the appended claims.

What is claimed is:

1. A safe utility knife comprising:

a housing having an inner space, a blade opening, a sliding recess, and a first securing portion; said housing having a front end and a rear end; said blade opening being disposed on said front opening; said first securing portion being adjacent to said rear end; said sliding recess being disposed on an upper surface of said housing and being connected to said inner space; said sliding recess having a locking recess;

a blade sliding seat being movable in said inner space back and forth and having at least a blade storing position and a blade protruding position; said blade sliding seat being disposed with a second securing portion, an acceleration detector shaft, a stopper shaft, a central block, and a curved sliding path zone; said curved sliding path zone including a front section, a curved section, and a rear section; said front section being a section toward said front end, said central block being between said front end and said rear end, said curved section being substantially positioned beneath said central block;

a pulling force generator having two ends, one end being connected with said first securing portion and the other end being connected with said second securing portion, said pulling force generator being provided for pulling said blade sliding seat back to said blade storing position;

an acceleration detector being pivoted on said acceleration detector shaft and being rotatable between a low acceleration position and a high acceleration position; said acceleration detector having a first hole, a weighting element, and a safety locker;

a stopper being movable between a locking position and a non-locking position, said stopper having a stopping protruding portion and a locking protruding portion;

a stopper pushing portion biasing said stopper with respect to said non-locking position and said locking position; and a sliding switch being secured on said blade sliding seat and being movable along said sliding recess; said sliding switch having a pushing portion, a rotatable controlling arm, and a resilient element; said rotatable controlling arm having a controller jut movable in said curved sliding path zone;

wherein when said acceleration detector is positioned at said low acceleration position, said safety locker is positioned behind said central block and said controlling jut of said rotatable controlling arm is positioned in said rear section of said curved sliding path zone, said pushing portion being pushed to cause said blade sliding seat movement forward from said blade storing position to said blade protruding position, said locking protruding portion of said stopper being thereby positioned at said locking recess of said housing to lock said blade sliding seat; responsive to an acceleration caused by a sudden dropping movement exceeding a predetermined value, said weighting element moving up to cause said acceleration detector movement from said low acceleration position to said high acceleration position and force said safety locker to press down said rotatable controlling arm and said stopper so that said stopper moves from said locking position to said non-locking position; and, said locking protruding portion of said stopper leaving from said locking recess to cause said blade sliding seat to be pulled back by said pulling force generator to said blade storing position for safe and automatic blade returning function.

2. The safe utility knife as claimed in claim 1, wherein said pushing force generator is a spring.

3. The safe utility knife as claimed in claim 1, wherein said stopper pushing portion is a spring.

4. The safe utility knife as claimed in claim 1, wherein said resilient element is a spring.

5. The safe utility knife as claimed in claim 1, wherein said acceleration detector has a first hole, and said first hole of said acceleration detector is pivoted with the acceleration detector shaft.

6. The safe utility knife as claimed in claim 1, further comprising a locking switch, said locking switch being disposed on said housing and having at least a locked position and a released position, said locking switch including a locking portion, said safety locker further including an extending portion; when said locking switch is positioned at said locked position, said locking portion being beneath the extending portion so that the acceleration detector cannot rotate on the acceleration detector shaft and said acceleration detector is locked at the low acceleration position; when the locking switch moves to the released position, said locking portion moving away from the position beneath the extending portion, said acceleration detector is rotatable to any angle between the low acceleration position and the high acceleration position.

7. The safe utility knife as claimed in claim 1, wherein said stopper is movable between said locking position and said non-locking position along a straight line.

8. The safe utility knife as claimed in claim 1, wherein said stopper is movable angularly between a locking position and a non-locking position; said stopper having a second hole, said second hole being pivoted with the stopper shaft, whereby said stopper is rotatable between said locking position and said non-locking position.

* * * * *